US008029314B2

(12) United States Patent
Huang

(10) Patent No.: US 8,029,314 B2
(45) Date of Patent: Oct. 4, 2011

(54) CONNECTOR FOR MOUNTING A FLEXIBLE PRINTED CIRCUIT BOARD

(75) Inventor: Ying Che Huang, Changhua County (TW)

(73) Assignee: Hannstar Display Corp., Taipei County (TW)

( * ) Notice: Subject to any disclaimer, the term of this patent is extended or adjusted under 35 U.S.C. 154(b) by 0 days.

(21) Appl. No.: 12/851,586

(22) Filed: Aug. 6, 2010

(65) Prior Publication Data

US 2011/0069430 A1 Mar. 24, 2011

(30) Foreign Application Priority Data

Sep. 24, 2009 (TW) ..... 98132238 A

(51) Int. Cl.
*H01R 3/00* (2006.01)

(52) U.S. Cl. ..... 439/492

(58) Field of Classification Search ..... 439/492, 439/495, 260, 261, 77
See application file for complete search history.

(56) References Cited

U.S. PATENT DOCUMENTS

| | | | | |
|---|---|---|---|---|
| 4,934,947 | A * | 6/1990 | Brummans | 439/77 |
| 5,934,933 | A * | 8/1999 | Kordecki et al. | 439/495 |
| 5,951,322 | A * | 9/1999 | Nishikigi | 439/456 |
| 6,267,620 | B1 * | 7/2001 | Ma | 439/495 |
| 6,394,838 | B1 * | 5/2002 | Yen | 439/492 |
| 6,471,541 | B2 * | 10/2002 | Kunishi et al. | 439/495 |
| 7,101,220 | B2 * | 9/2006 | Satou | 439/492 |
| 7,387,528 | B2 * | 6/2008 | Lee et al. | 439/495 |
| 7,435,122 | B2 * | 10/2008 | Suzuki et al. | 439/260 |
| 7,448,893 | B2 * | 11/2008 | Suzuki | 439/260 |
| 7,491,088 | B2 * | 2/2009 | Suzuki et al. | 439/607.01 |
| 7,494,366 | B2 * | 2/2009 | Suzuki et al. | 439/495 |
| 7,540,764 | B2 * | 6/2009 | Suzuki et al. | 439/495 |
| 7,563,128 | B2 * | 7/2009 | Suzuki et al. | 439/495 |
| 7,591,661 | B2 * | 9/2009 | Suzuki et al. | 439/260 |
| 7,766,680 | B2 * | 8/2010 | Suzuki et al. | 439/260 |
| 7,819,691 | B2 * | 10/2010 | Ryu | 439/495 |
| 7,854,541 | B2 * | 12/2010 | Kim | 362/646 |
| 7,887,351 | B2 * | 2/2011 | Wang et al. | 439/260 |
| 2001/0027056 | A1 * | 10/2001 | Sawayanagi | 439/492 |
| 2004/0248460 | A1 * | 12/2004 | Masaki et al. | 439/492 |
| 2005/0215109 | A1 * | 9/2005 | Satou | 439/492 |
| 2006/0035515 | A1 * | 2/2006 | Pabst | 439/492 |
| 2006/0035516 | A1 * | 2/2006 | Wu et al. | 439/492 |
| 2006/0084311 | A1 * | 4/2006 | Suzuki et al. | 439/260 |
| 2006/0172588 | A1 * | 8/2006 | Peng | 439/492 |
| 2006/0286831 | A1 * | 12/2006 | Kwon et al. | 439/108 |
| 2007/0021007 | A1 * | 1/2007 | Park | 439/610 |
| 2008/0079888 | A1 * | 4/2008 | Park | 349/149 |
| 2008/0139008 | A1 * | 6/2008 | Lee et al. | 439/58 |
| 2008/0188099 | A1 * | 8/2008 | Takahashi | 439/77 |
| 2010/0261375 | A1 * | 10/2010 | Wang et al. | 439/492 |

* cited by examiner

*Primary Examiner* — Tulsidas Patel
*Assistant Examiner* — Vladimir Imas

(57) ABSTRACT

A connector is adapted to mount a FPC board. The connector includes a base and a cover. The base includes an opening and a first connecting portion located at two sides of the opening. The cover is pivotally connected to the base, and includes a second connecting portion, wherein when the cover is turned and then the second connecting portion is engaged with the first connecting portion, there is an accommodating space formed between the cover and the opening of the base for accommodating the FPC board, and the first and second connecting portions are adjacent to the position portion, whereby the position portion cannot escape from the accommodating space.

18 Claims, 15 Drawing Sheets

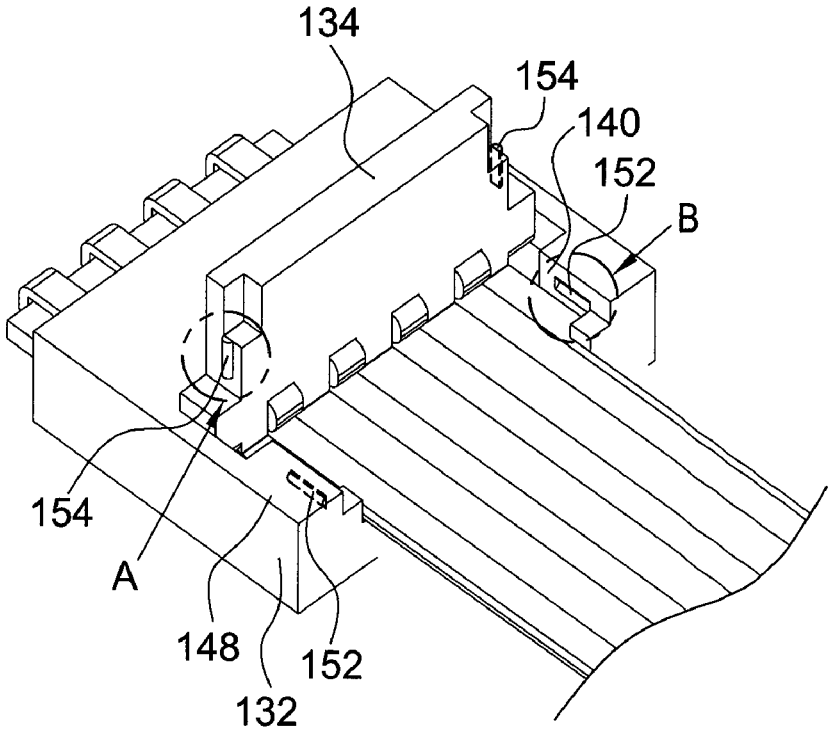
FIG.8
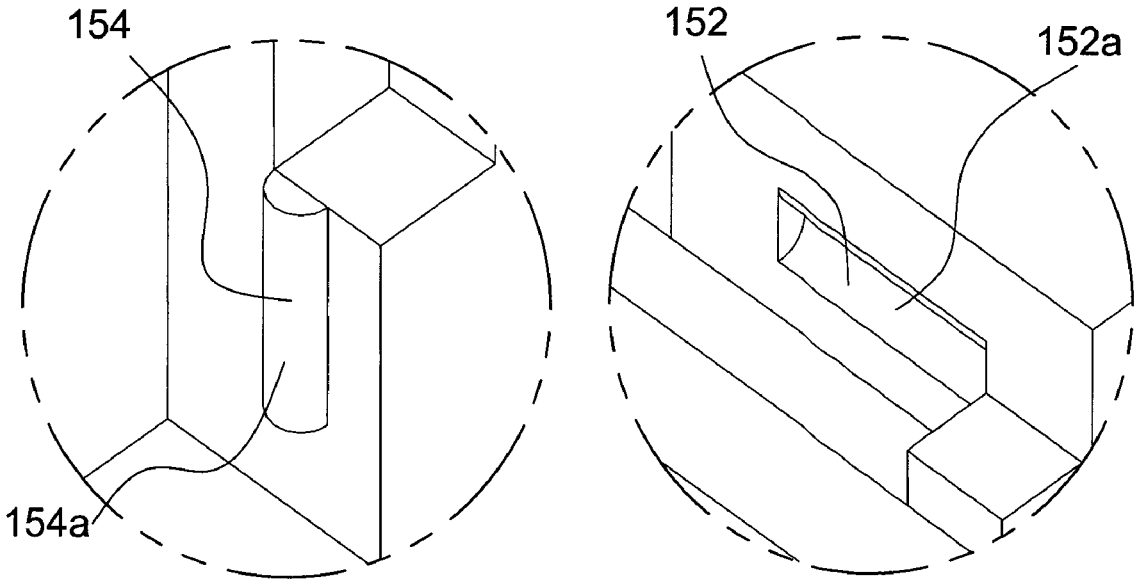
Portion A
Portion B

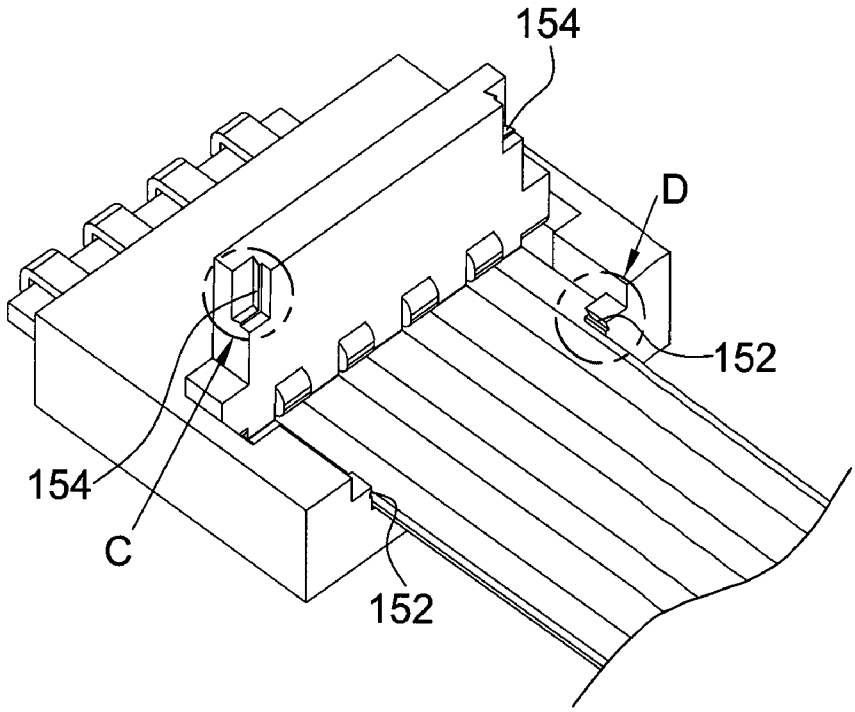
FIG.9
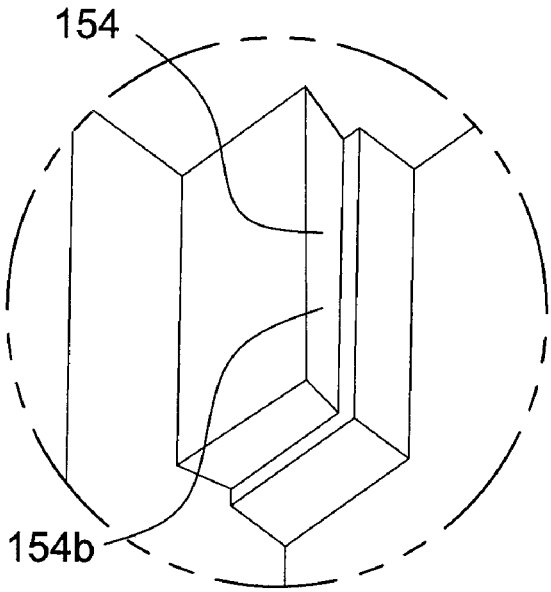
Portion C
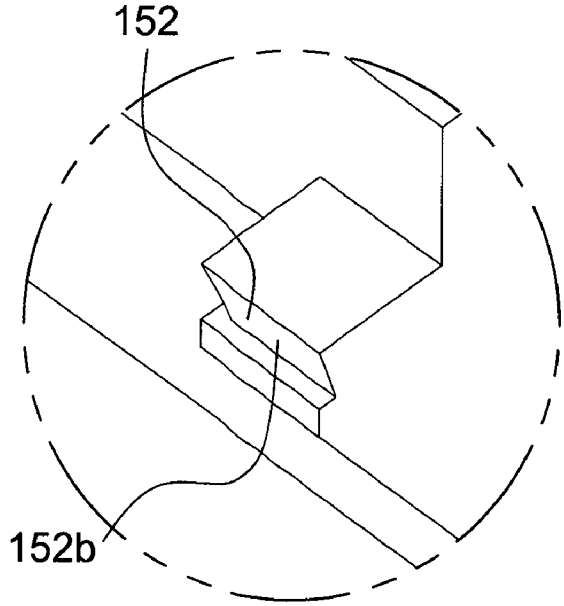
Portion D

CONNECTOR FOR MOUNTING A FLEXIBLE PRINTED CIRCUIT BOARD

CROSS REFERENCE TO RELATED APPLICATION

This application claims the priority benefit of Taiwan Patent Application Serial Number 098132238, filed on Sep. 24, 2009, the full disclosure of which is incorporated herein by reference.

TECHNICAL FIELD

The invention is related to a connector for mounting a FPC board, and more particularly to a connector of a display device.

BACKGROUND

A flexible printed circuit (FPC) board is a component for transmitting signals, and it has advantages of small volume, flexibility and high capacity for signal transmission. Therefore, the FPC board is widely applied to various electronic products. Recently, the FPC board is generally cooperated with a connector so as to transmit signals or power between two systems (or devices).

Referring to FIG. 1, a conventional connector 30 for mounting a FPC board 26 is a rotatable cover type connector, which utilizes a rotatable cover 34 to downward touch and press the FPC board 26 so as to mount the FPC board 26, whereby electrical contacts (not shown) of the FPC board 26 are electrically connected to electrical contacts (not shown) of a printed circuit board (PCB) 16. The rotatable cover type connector can be conveniently assembled or disassembled with the FPC board 26. However, the above-mentioned connectors 26 is lack of an immovable mechanism, i.e. the above-mentioned connectors 30 have no proper mechanism for fastening the FPC board 26 when the rotatable cover 34 is turned to a lowest position. If the rotatable cover 34 is pulled by external force or the FPC board 26 is outward pulled by an external force, the rotatable cover 34 is often opened, such that the FPC board 26 escapes from the connector 30, and then the electrical connection between the FPC board 26 and the PCB 16 is unsuccessful.

A light bar of a backlight module of a liquid crystal display device is electrically connected to the connector 30 of the PCB 16 through the FPC board 26, thereby energizing the light bar to illumine a liquid crystal display panel. However, the conventional connector 30 has no immovable mechanism for fastening FPC board 26, such that the FPC board 26 possibly escapes from the connector 30 during assembling and test processes of the liquid crystal panel, and then the light bar cannot be energized to illumine the liquid crystal display panel. In order to resolve the above-mentioned problem, a FPC tape (shown as dotted line 28) is attached on the connection portion between the FPC board 26 and the connector 30, whereby the FPC board 26 cannot escape from the connector 30. But, rework time can be increased, if the FPC board 26 must be disassembled and then assembled with the connector 30. More detailed, the FPC tape is removed, the FPC board 26 might be pulled out by external force, then the FPC board 26 is inserted into connector again, and finally the FPC tape is accurately attached back to achieve electrical connection. Thus, repeated processes of the FPC tape certainly increase rework time, and are inconvenient to a worker.

Accordingly, there exists a need for a connector for mounting a FPC board capable of solving the above-mentioned problems.

SUMMARY

The present invention provides a connector adapted to mount a FPC board. The connector includes a base and a cover. The base includes an opening and a first connecting portion located at two sides of the opening. The cover is pivotally connected to the base, and includes a second connecting portion, wherein when the cover is turned and then the second connecting portion is engaged with the first connecting portion, there is an accommodating space formed between the cover and the opening of the base for accommodating the FPC board, and the first and second connecting portions are adjacent to the position portion of the FPC board, whereby the position portion cannot escape from the accommodating space.

If the cover of the present invention is pulled by external force or the FPC board is outward pulled by an external force, the cover cannot be opened and the FPC board doesn't escapes from the connector, because the engaging connection between the second connecting portion and the first connecting portion is applied to the connector. Thus, the electrical connection between the FPC board and the PCB cannot be unsuccessful.

The foregoing, as well as additional objects, features and advantages of the invention will be more apparent from the following detailed description, which proceeds with reference to the accompanying drawings.

BRIEF DESCRIPTION OF THE DRAWINGS

Embodiments of the present invention are illustrated by way of example, and not by limitation, in the figures of the accompanying drawings, wherein elements having the same reference numeral designations represent like elements throughout and wherein:

FIG. 8 is a perspective schematic view of the FPC board and the connector according to another embodiment of the present invention, showing that the third connecting portion includes a concave portion and the fourth connecting portion includes a convex portion;

FIG. 9 is a perspective schematic view of the FPC board and the connector according to another alternative embodiment of the present invention, showing that the third connecting portion includes a convex inclined surface and the fourth connecting portion includes a concave inclined surface;

DETAILED DESCRIPTION OF THE PREFERRED EMBODIMENT

Figure 1:
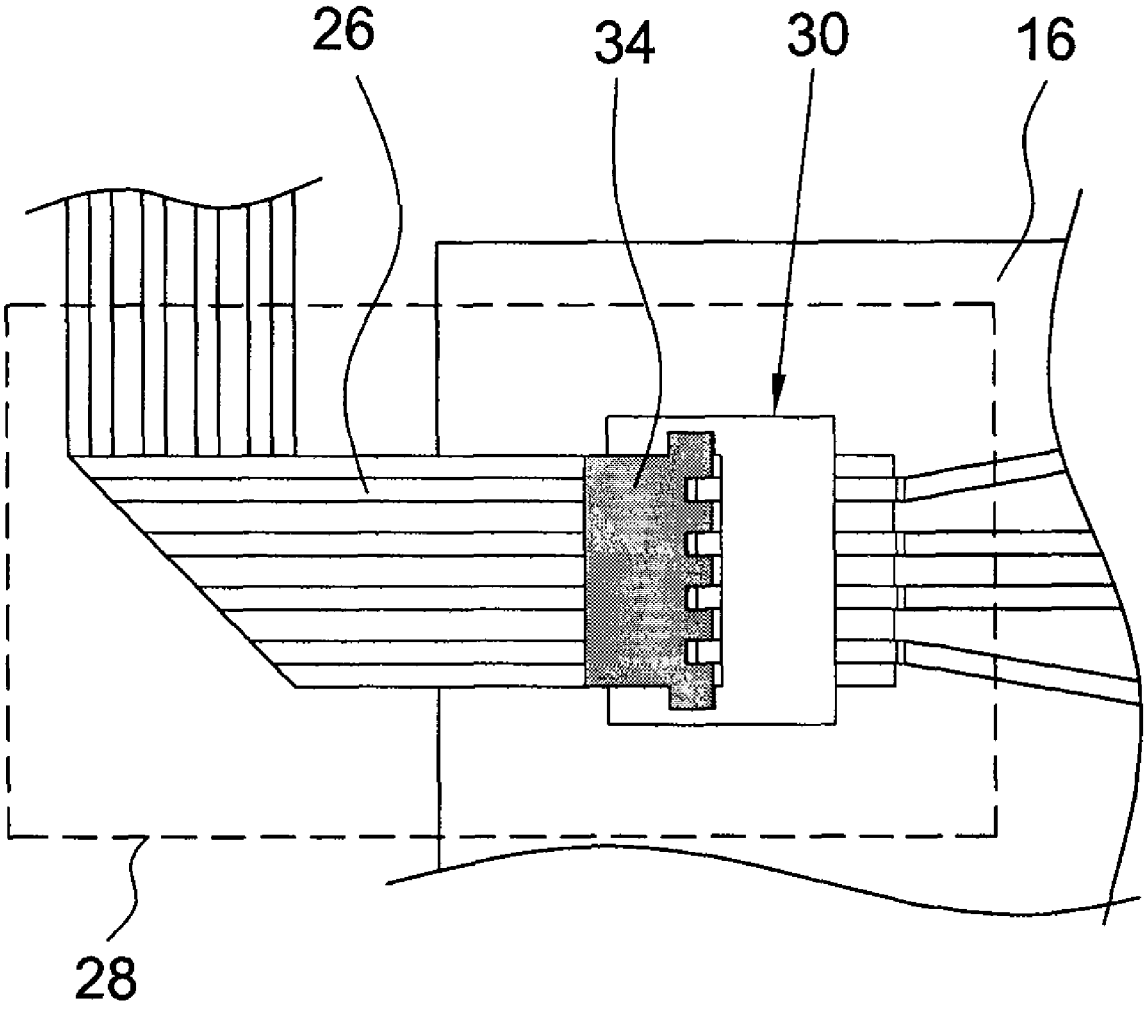
FIG.1(PRIOR ART)
FIG. 1 is a plan schematic view of a FPC board, a connector and a PCB in the prior art.
Figure 2:
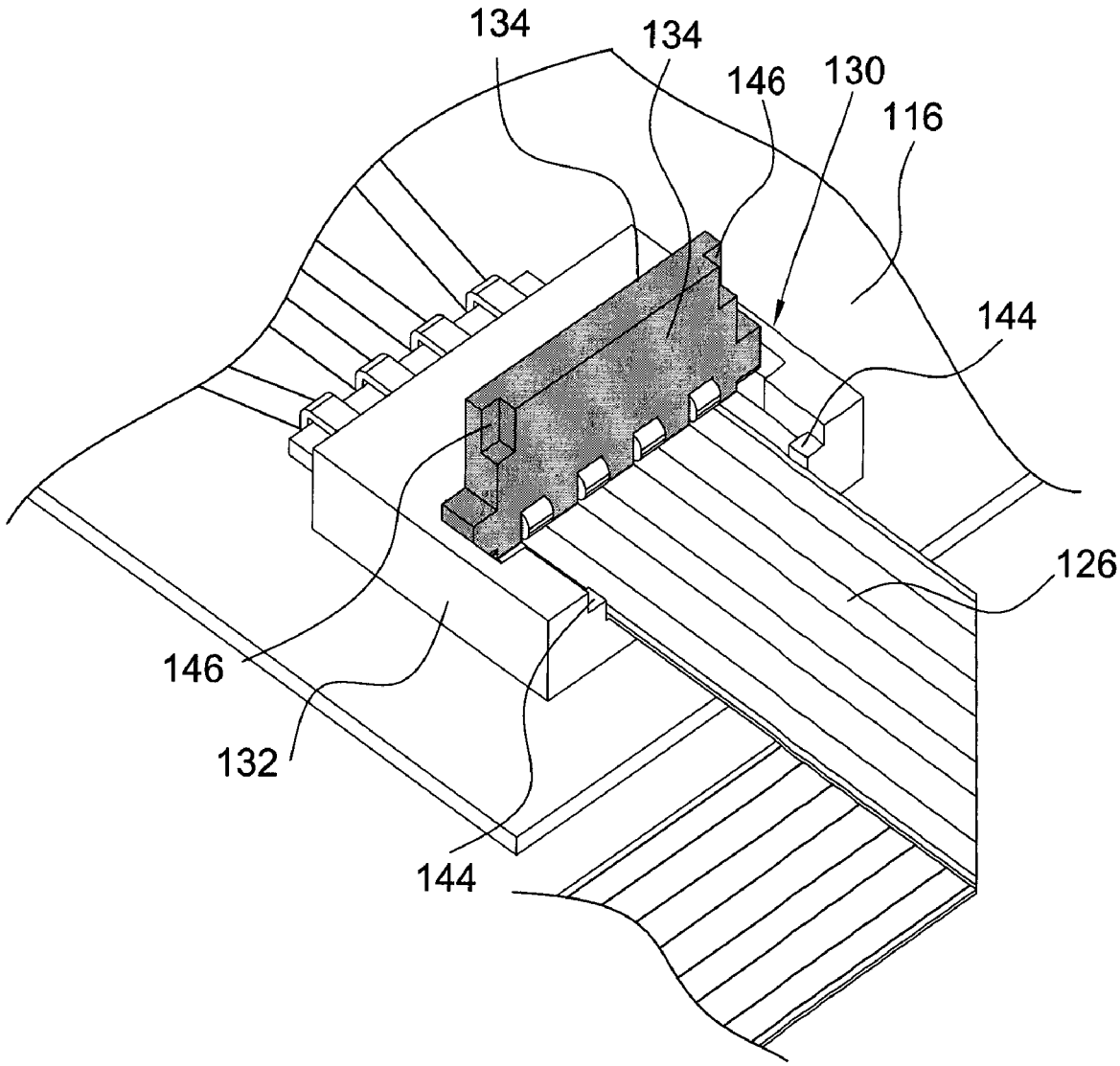
FIG. 2 is a perspective schematic view of a connector for mounting a FPC board according to an embodiment of the present invention, showing that a cover is open.
Figure 3A:
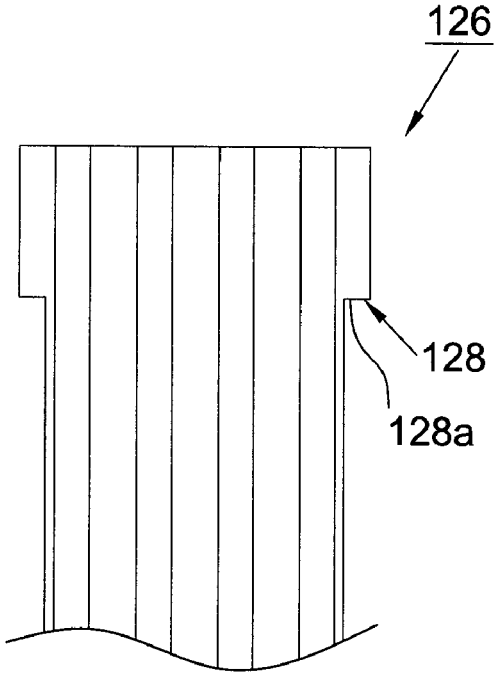
FIGS. 3*a* to 3*c* are plan schematic views of the FPC board according to the embodiment of the present invention.
Figure 3B:
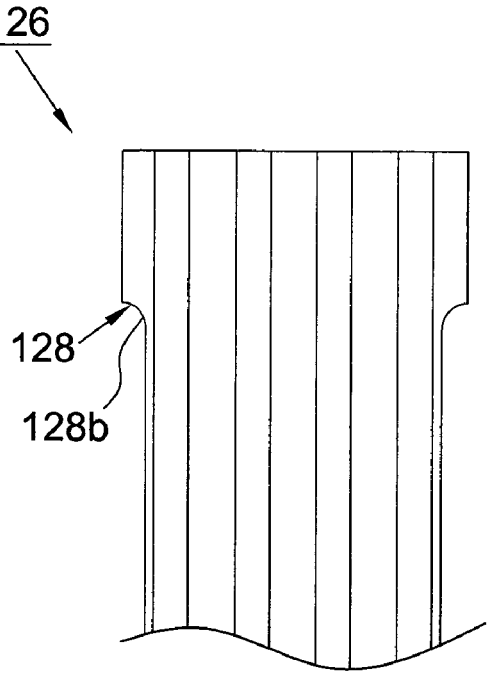
Figure 3C:
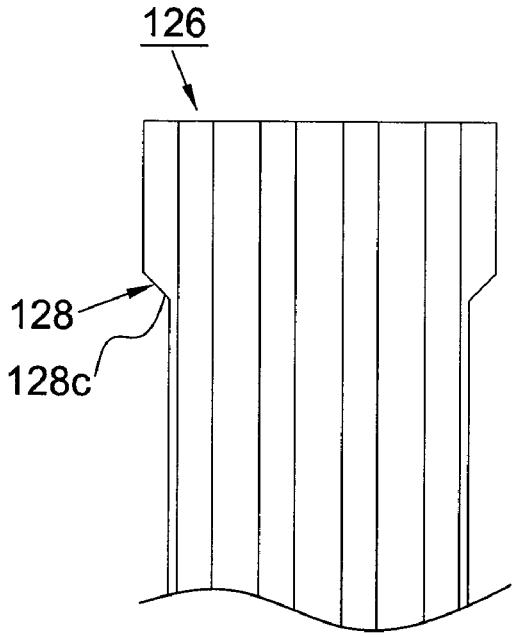
Figure 4:
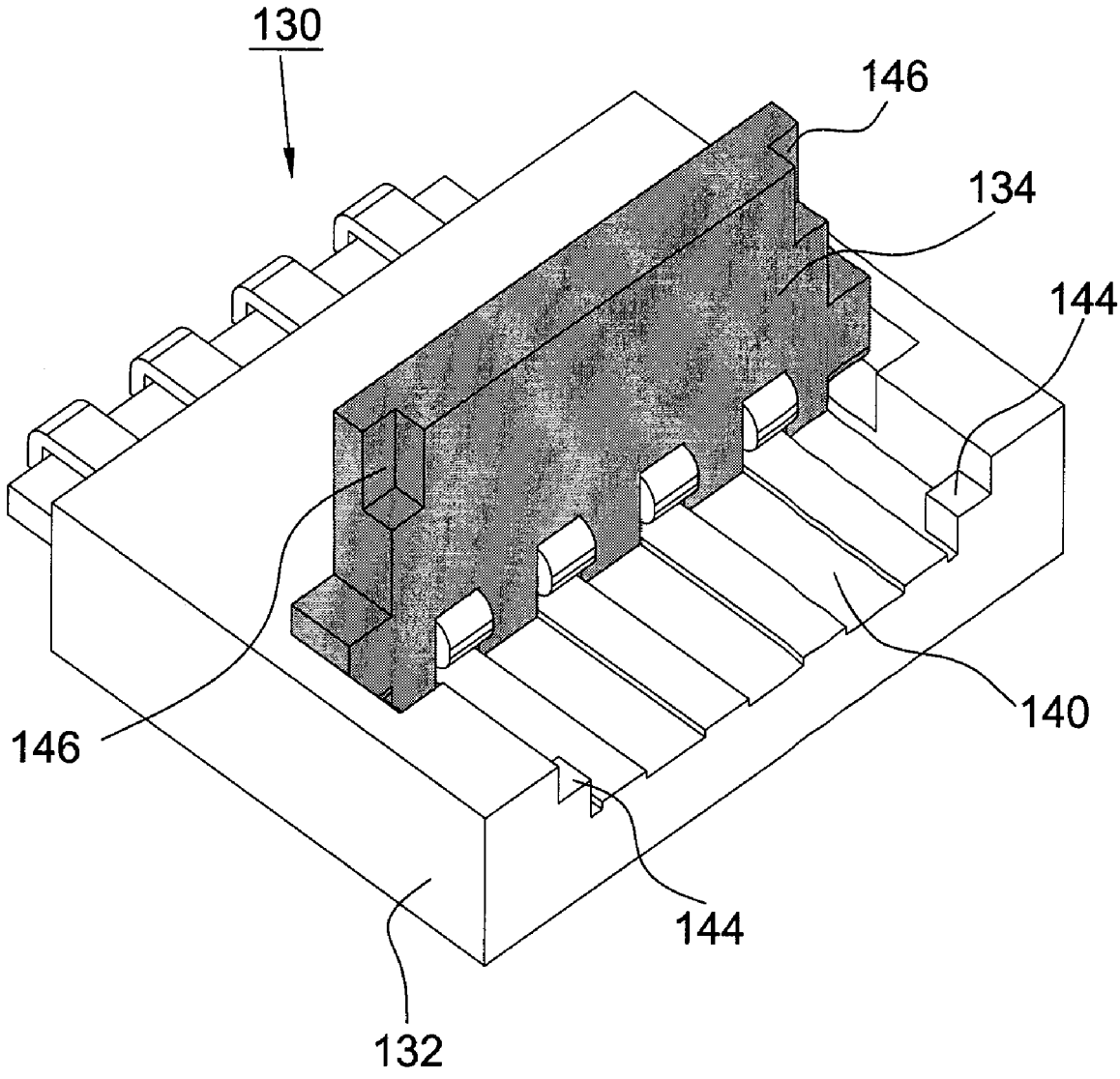
FIG. 4 is a perspective schematic view of the connector according to the embodiment of the present invention, showing that the cover is open.
Figure 5:
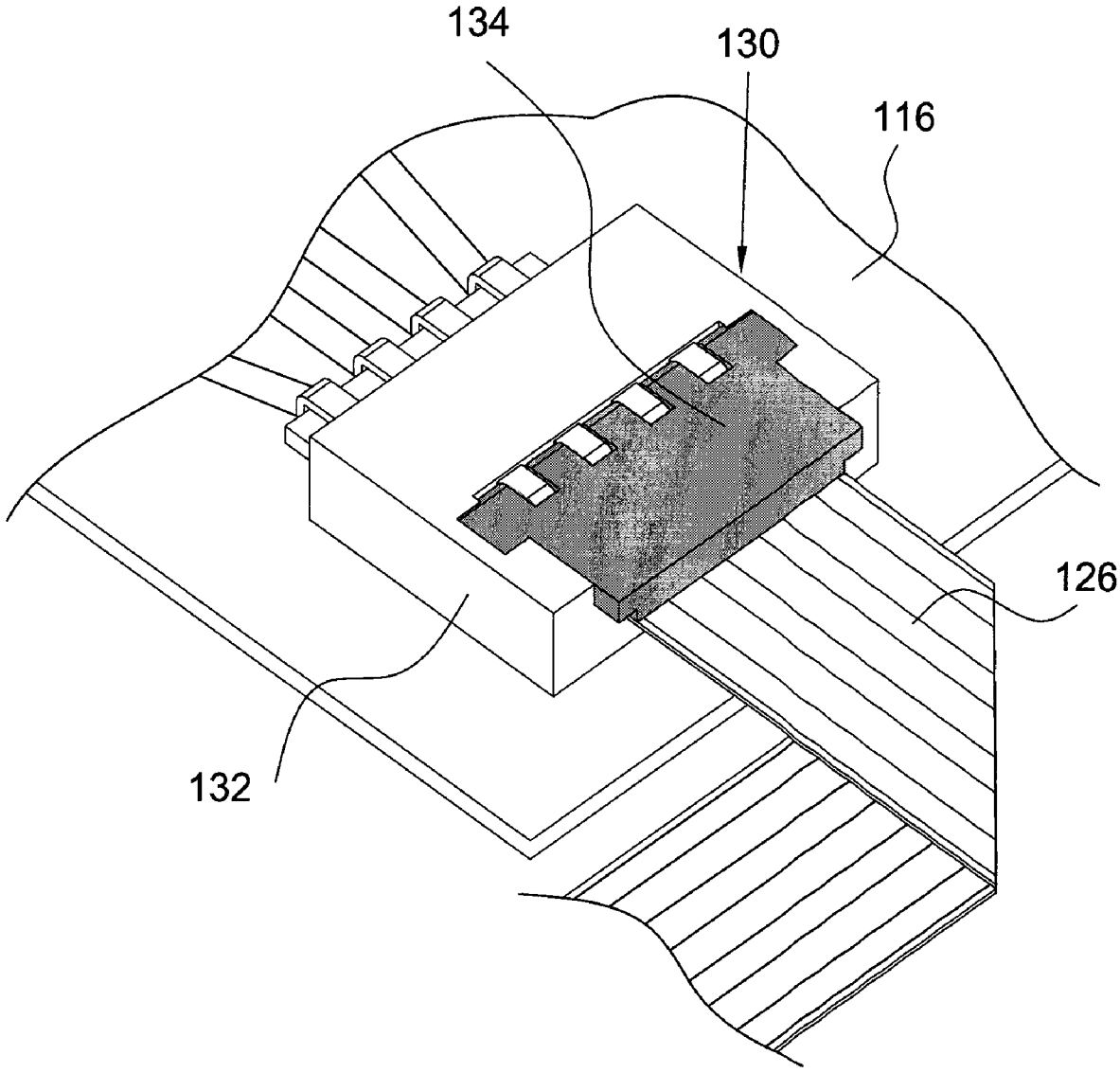
FIG. 5 is a perspective schematic view of the FPC board, the connector and the PCB according to the embodiment of the present invention, showing that the cover is closed.

Referring to FIG. 2, it depicts a connector 130 for mounting a flexible printed circuit (FPC) board 126 according to an embodiment of the present invention. The connector 130 is mounted and electrically connected to a printed circuit board (PCB) 116. Referring to FIGS. 3*a* to 3*c*, the FPC board 126 includes a positioning portion 128. The shape of the positioning portion 128 can be a rectangular indentation 128*a* (shown in FIG. 3*a*), a curved indentation 128*b* (shown in FIG. 3*b*) or an obtuse triangular indentation 128*c* (shown in FIG. 3*c*). Referring to FIG. 4, the connector 130 includes a base 132 and a cover 134. The base 132 includes an opening 140 and a first connecting portion 144 located at two sides of the opening 140. The cover 134 is pivotally connected to the base 132, and includes a second connecting portion 146. When the cover 134 is turned and then is engaged with the base 132, the second connecting portion 146 is engaged with the first connecting portion 144 in the up and down stacking manner, shown in FIG. 5. In this embodiment, the cover 134 projects from the base 132 after engagement. In another embodiment, the cover 134 aligns with the base 132 after engagement.

Figure 6A:
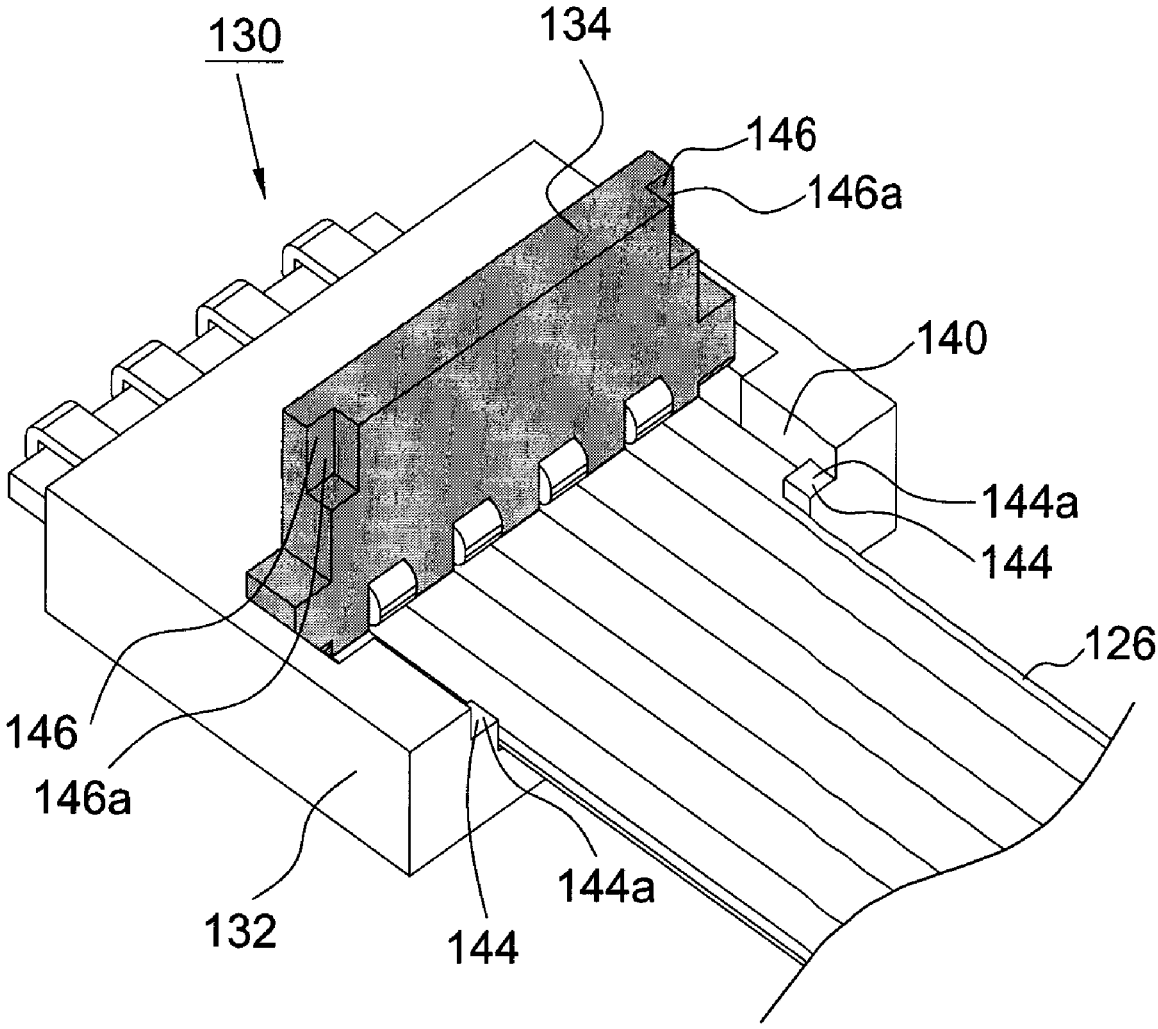
FIGS. 6*a* to 6*c* are perspective schematic views of the FPC board and the connector according to the embodiment of the present invention, showing that the first connecting portion includes a convex portion and the second connecting portion includes a concave portion.
Figure 6B:
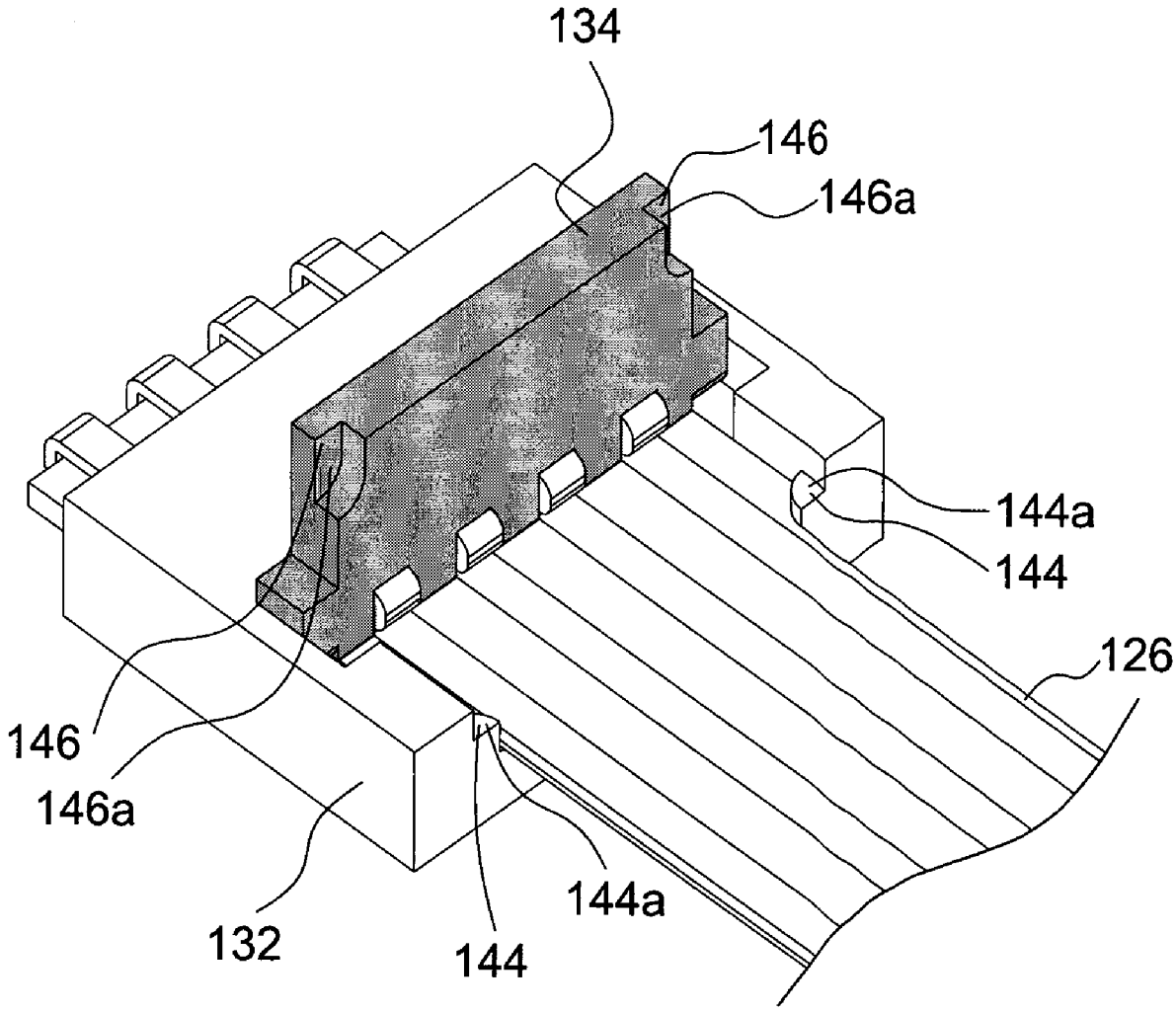
Figure 6C:
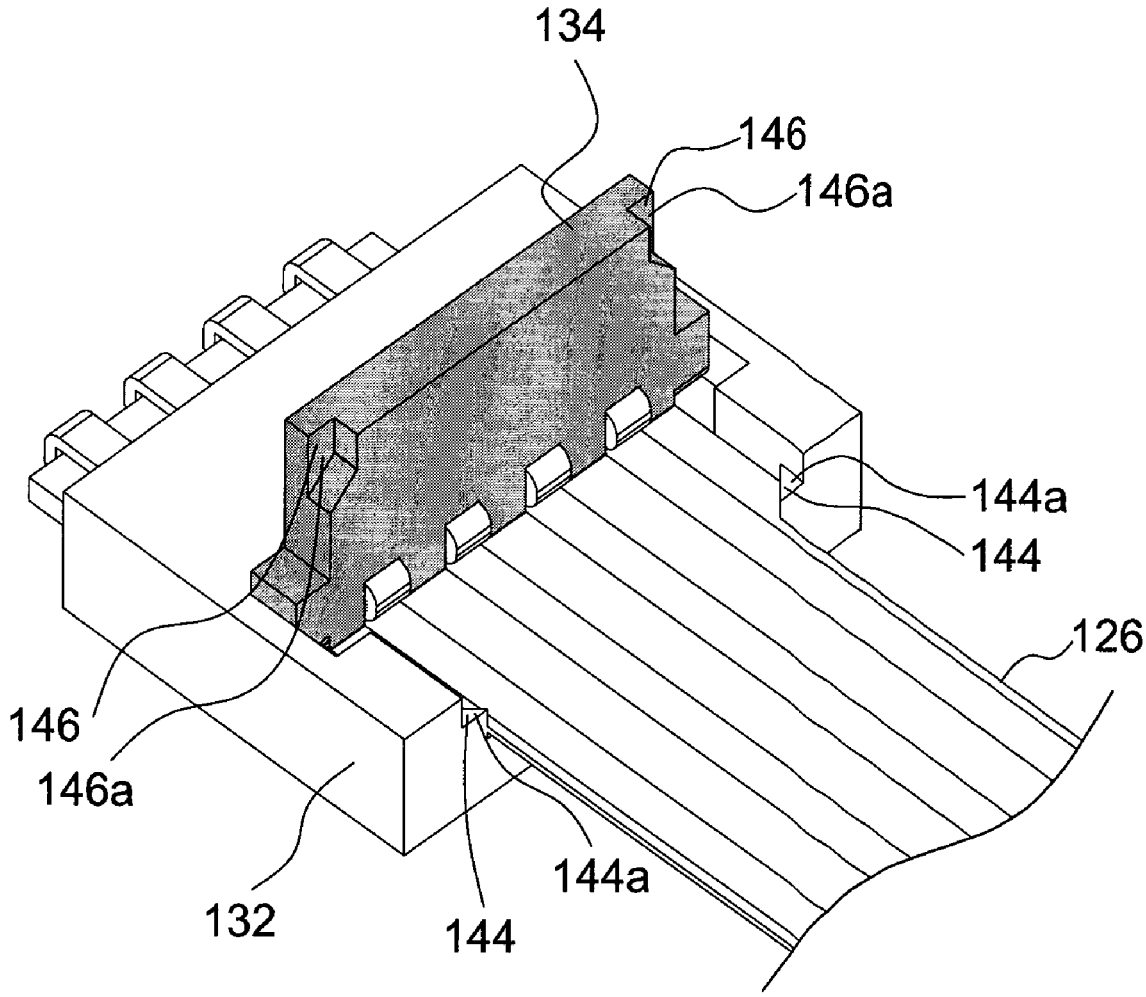

Referring to FIGS. 6*a* and 6*b*, in this embodiment the first connecting portion 144 of the base 132 includes a convex portion 144*a*, and the second connecting portion 146 of the cover 134 includes a concave portion 146*a*, which is engaged with the convex portion 144*a*. The convex portion 144*a* can be a rectangular convex portion (shown in FIG. 6*a*), a curved convex portion (shown in FIG. 6*b*) or a right triangular convex portion (shown in FIG. 6*c*). The concave portion 146*a* can be a rectangular concave portion (shown in FIG. 6*a*), a curved concave portion (shown in FIG. 6*b*) or a right triangular concave portion (shown in FIG. 6*c*). The curved convex portion can be a quarter circular convex portion, and the curved concave portion can be a quarter circular concave portion. It is noted that the base 132 includes a convex portion 144*a* and the cover 134 includes a concave portion 146*a*, and thus it is necessary that the FPC board 126 is inserted into the opening 140 of the base 132 in the inclined direction.

Figure 7A:
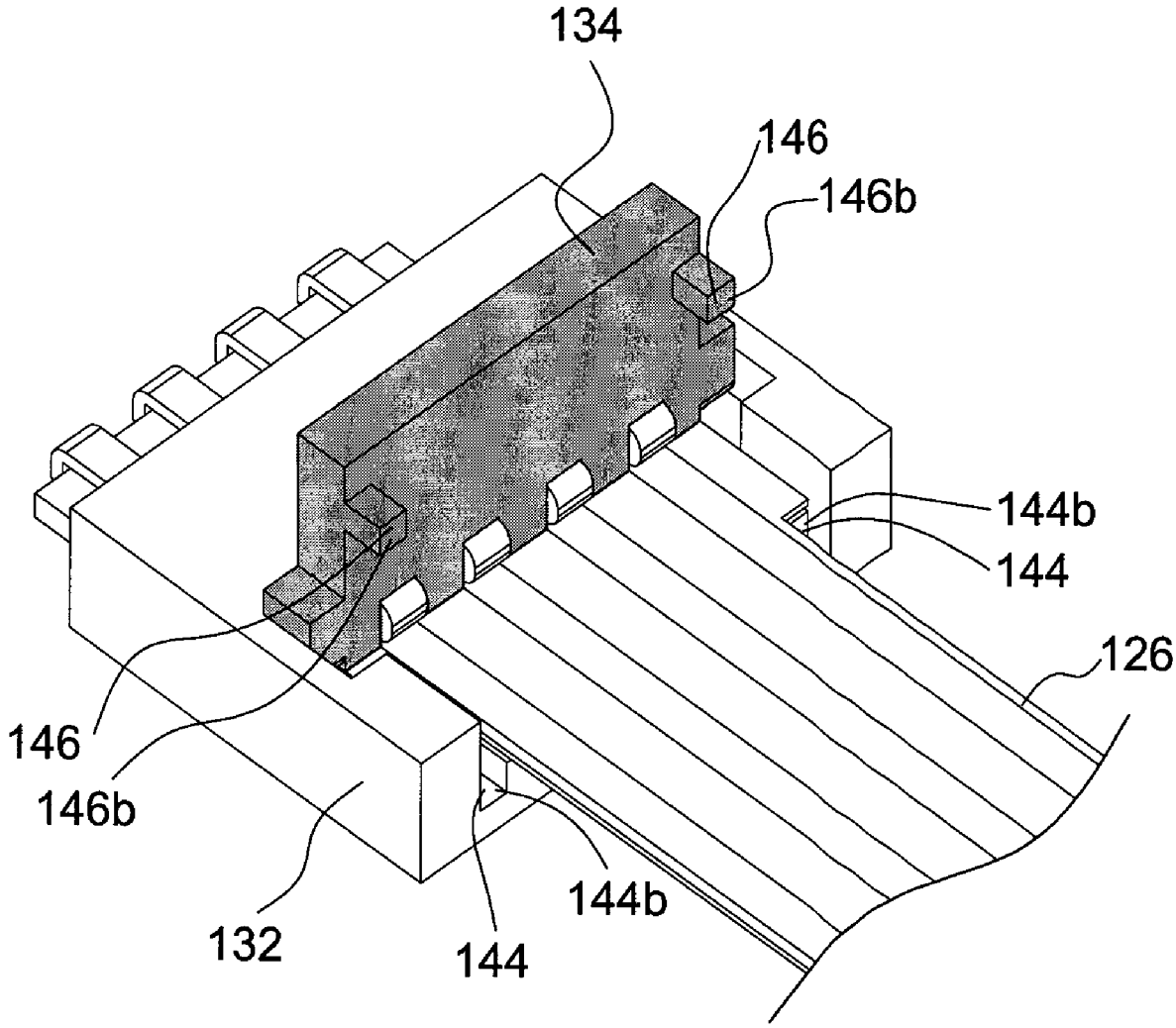
FIGS. 7*a* to 7*c* are perspective schematic views of the FPC board and the connector according to an alternative embodiment of the present invention, showing that the first connecting portion includes a concave portion and the second connecting portion includes a convex portion.
Figure 7B:
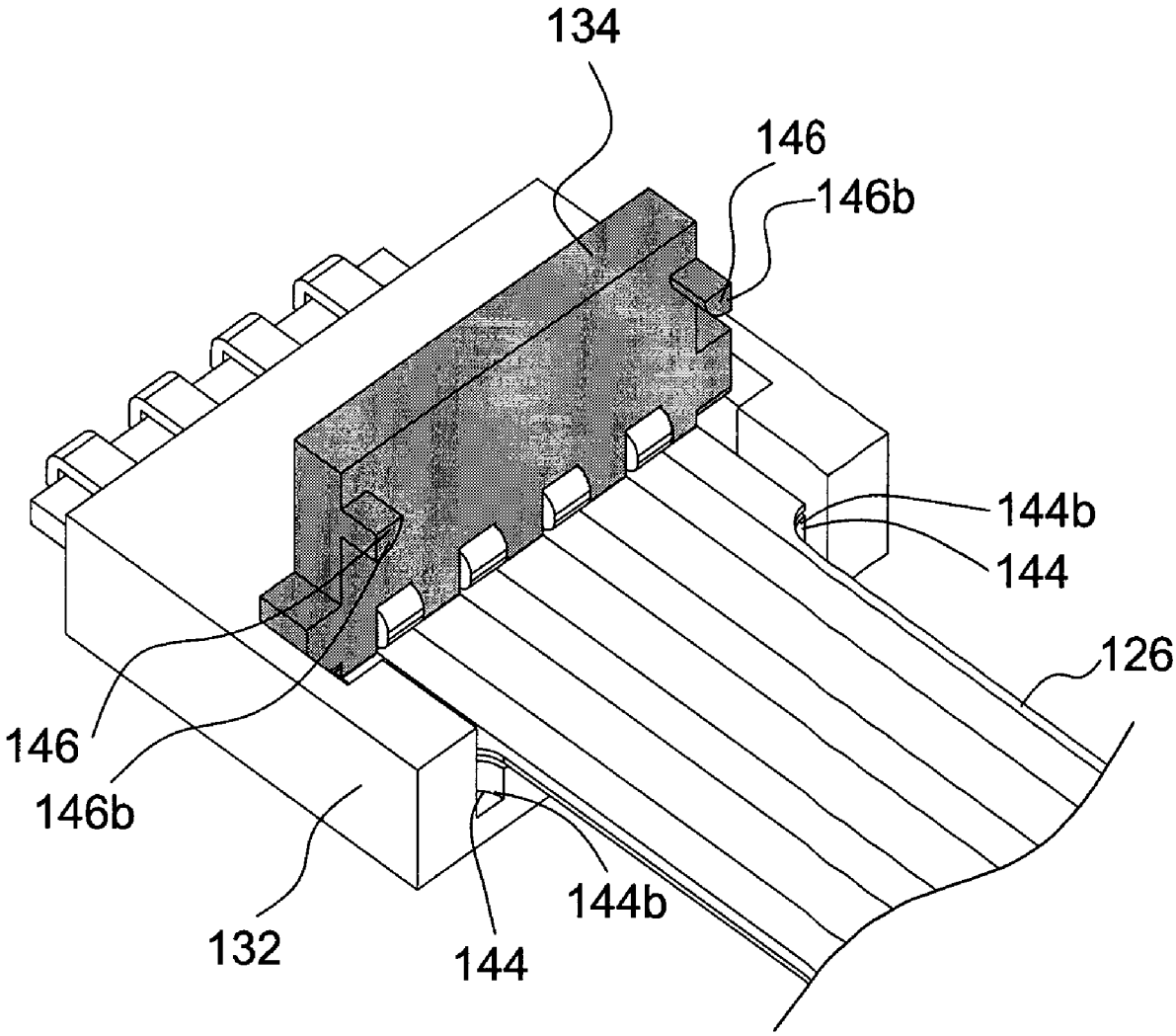
Figure 7C:
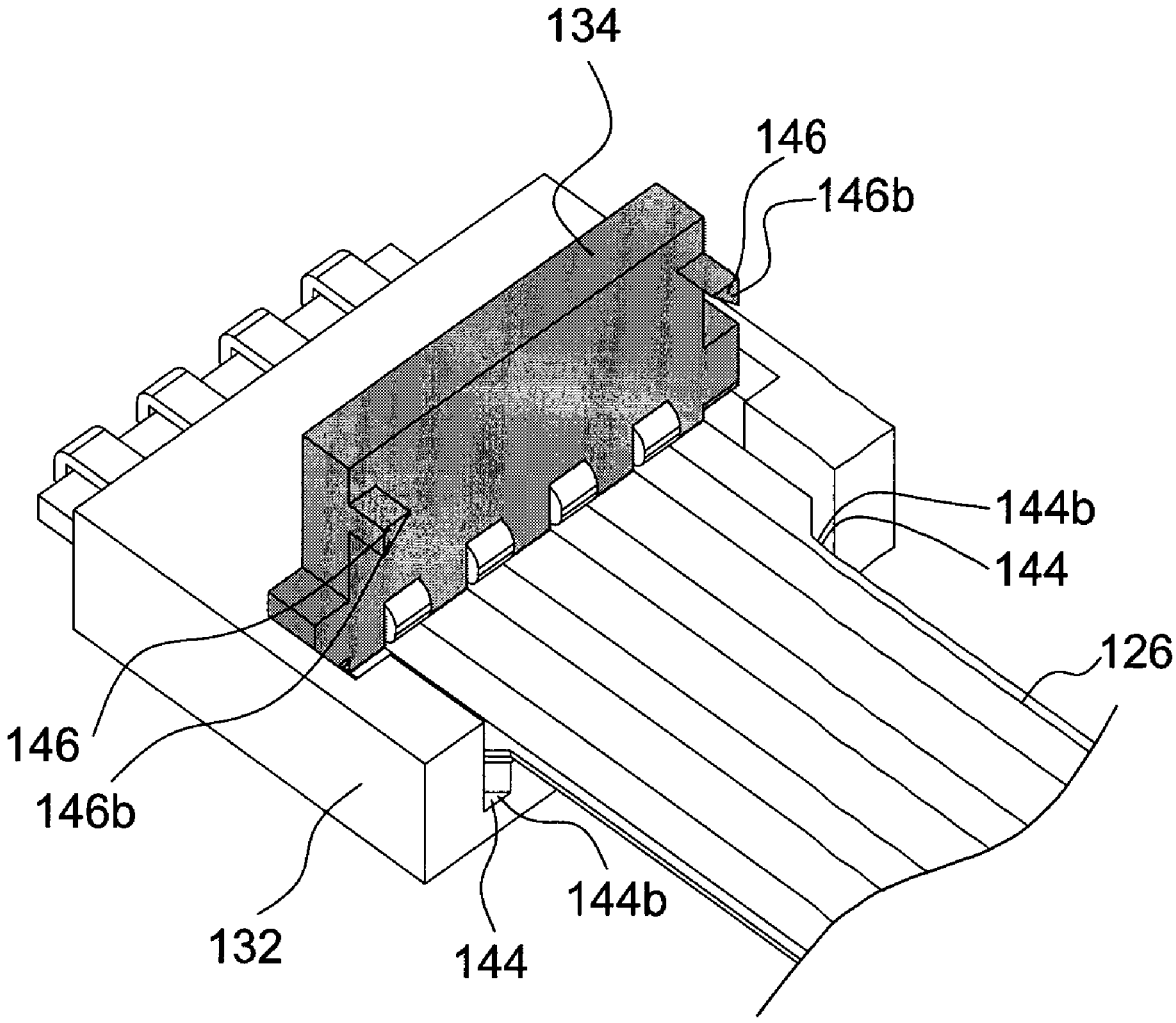

Referring to FIGS. 7*a* and 7*b*, in an alternative embodiment the first connecting portion 144 of the base 132 includes a concave portion 144*b*, and the second connecting portion 146 of the cover 134 includes a convex portion 146*b*, which is engaged with the concave portion 144*b*. The convex portion 146*b* can be a rectangular convex portion (shown in FIG. 7*a*), a curved convex portion (shown in FIG. 7*b*) or a right triangular convex portion (shown in FIG. 7*c*). The concave portion 144*b* can be a rectangular concave portion (shown in FIG. 7*a*), a curved concave portion (shown in FIG. 7*b*) or a right triangular concave portion (shown in FIG. 7*c*). The curved convex portion can be a quarter circular convex portion, and the curved concave portion can be a quarter circular concave portion. It is noted that the base 132 includes a concave portion 144*b* and the cover 134 includes a convex portion 146*b*, and thus it is not necessary that the FPC board 126 is inserted into the opening 140 of the base 132 in the inclined direction.

Referring to FIG. 6*a* again, when the cover 134 is turned and then the second connecting portion 146 is engaged with the first connecting portion 144, there is an accommodating space formed between the cover 134 and the opening 140 of the base 132 thereby accommodating a part of the FPC board 126. The first and second connecting portions 144, 146 are adjacent to the position portion 128 (shown in FIG. 3*a*) of the FPC board 126, whereby the position portion 128 cannot escape from the accommodating space. After the cover 134 is engaged with the base 132, electrical contacts (not shown) of the FPC board 126 are electrically connected to electrical contacts (not shown) of a printed circuit board (PCB) 116.

Referring to FIG. 8, the base 132 further includes a third connecting portion 152, the third connecting portion 152 can be adjacent to short sides 148 of the base 132 or two sides of the opening 140. The cover 134 further includes a fourth connecting portion 154, which is snapped into the third connecting portion 152, whereby the cover 134 is further mounted to the base 132. The fourth connecting portion 154 can be snapped into the third connecting portion 152 in the up and down stacking manner. In this embodiment, the third connecting portion 152 includes a concave portion 152*a*, and the fourth connecting portion 154 includes a convex portion 154*a*, which is snapped into the concave portion 152*a* (shown in FIG. 8). In an alternative embodiment, the third connecting portion 152 includes a convex portion (not shown), and the fourth connecting portion 154 includes a concave portion (not shown), which is snapped into the concave portion. The volume of the convex portion is substantially the same as that of the concave portion. The convex portion can be a bar-shaped convex portion. The concave portion can be a bar-shaped concave portion. Referring to FIG. 9, in another embodiment the third connecting portion includes a convex inclined surface, the fourth connecting portion includes a concave inclined surface, and the convex inclined surface is snapped into the concave inclined surface. In another alternative embodiment, the third connecting portion includes a concave inclined surface (not shown), the fourth connecting portion includes a convex inclined surface (not shown), and the convex inclined surface is snapped into the concave inclined surface. It is noted that the snapping connection between the fourth connecting portion 154 and the third connecting portion 152 can be dependently applied to the connector without the engaging connection between the second connecting portion 146 and the first connecting portion 144 simultaneously.

If the cover of the present invention is pulled by external force or the FPC board is outward pulled by an external force, the cover cannot be opened and the FPC board doesn't escapes from the connector, because the engaging connection between the second connecting portion and the first connecting portion is applied to the connector or the snapping connection between the fourth connecting portion and the third connecting portion is applied to the connector. Thus, the electrical connection between the FPC board and the PCB cannot be unsuccessful.

Figure 10:
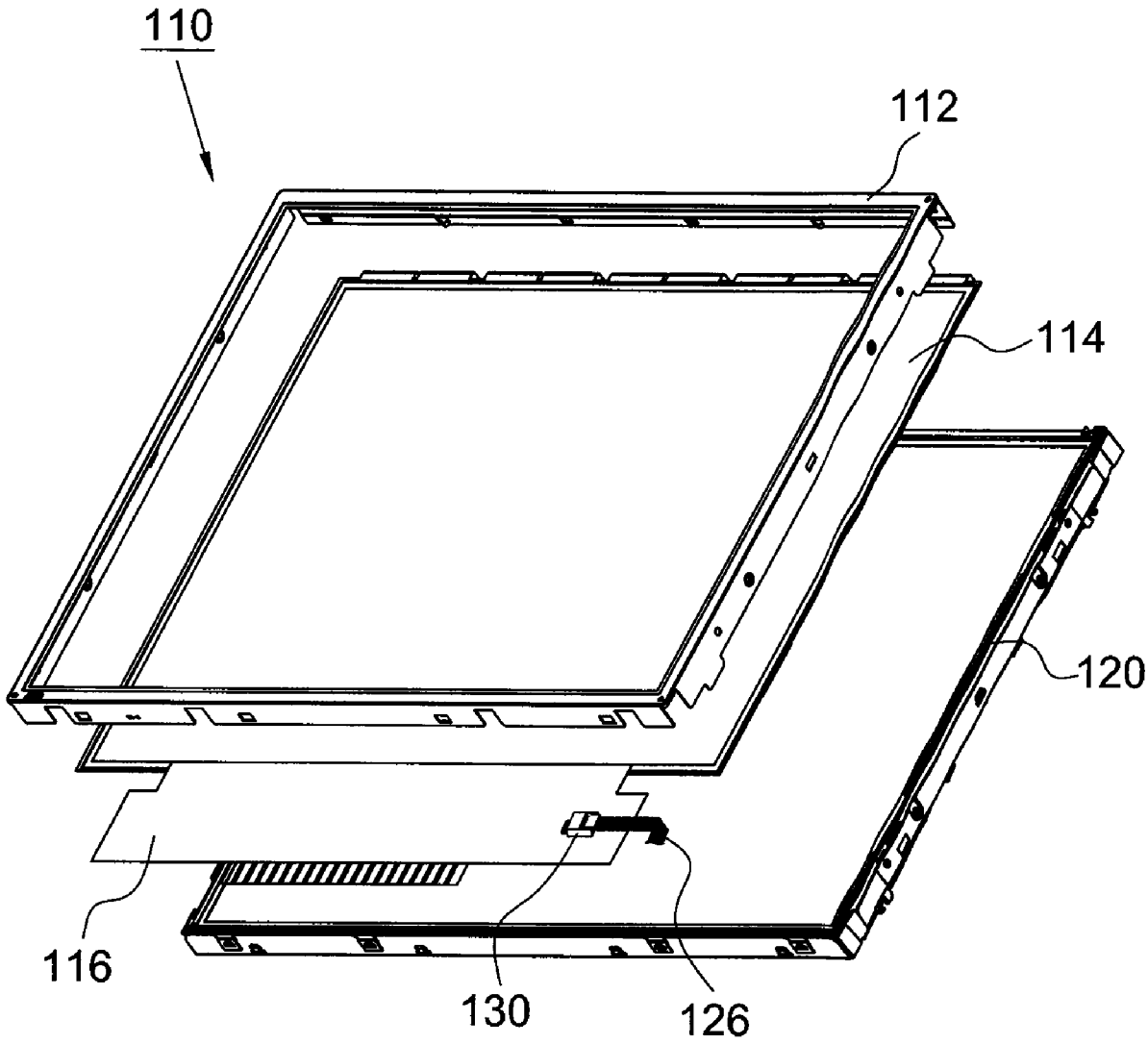
FIG. 10 is a perspective schematic view of a liquid crystal display device according to an embodiment of the present invention.
Figure 11:
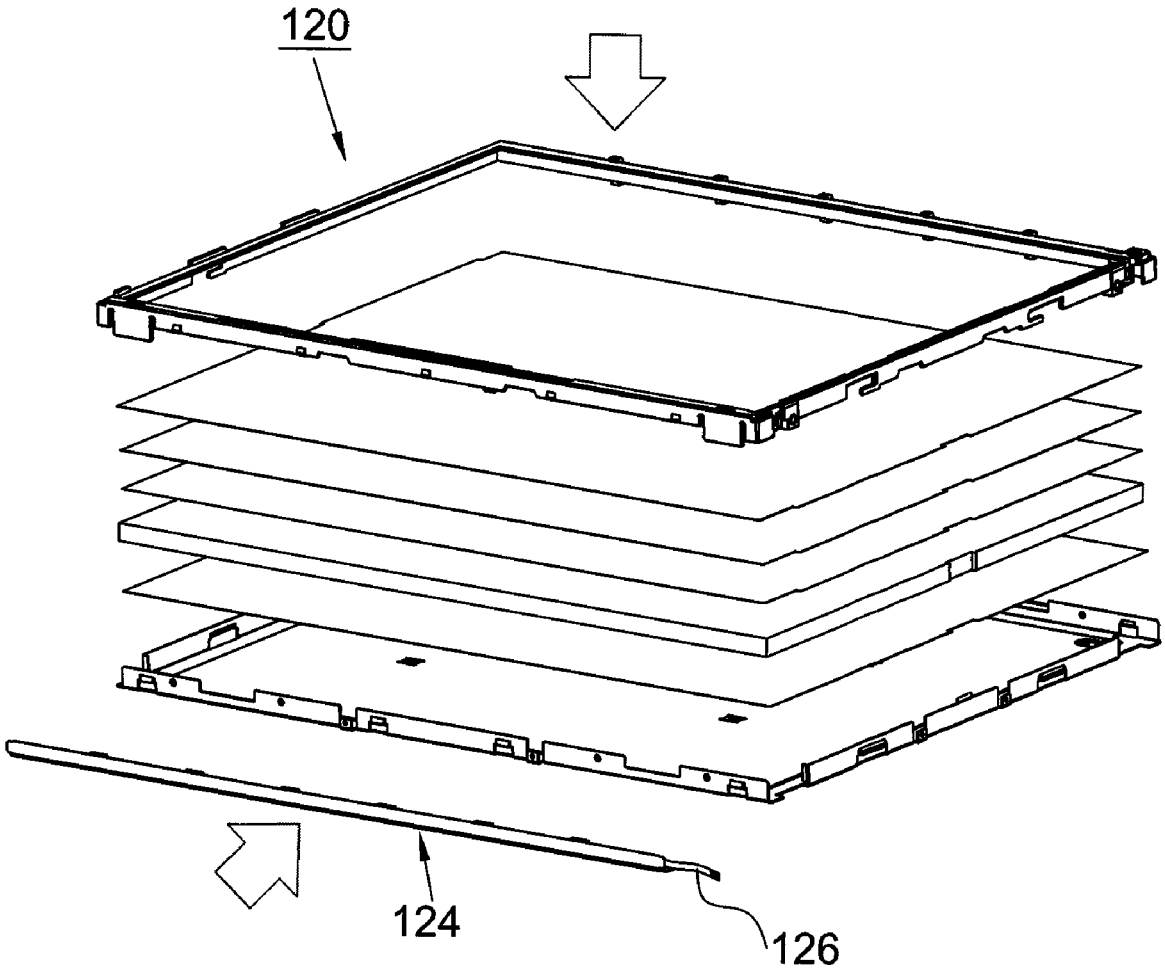
FIG. 11 is a perspective schematic view of a backlight module according to an embodiment of the present invention.

Referring to FIG. 10, it depicts a display device according to an embodiment of the present invention, i.e. the connector of the present invention can be adapted to a display device, e.g. liquid crystal display device 110. The liquid crystal display device 110 includes a front frame 112, a display panel (e.g. liquid crystal display panel 114) and a backlight module 120. The liquid crystal display panel 114 has a crystal liquid layer (not shown) disposed between upper and lower substrates (not shown) for displaying images. The liquid crystal display panel 114 includes a circuit board (e.g. printed circuit board 116) and the connector 130 of the present invention, and the connector 130 is disposed on the printed circuit board 116. The printed circuit board 116 is adapted to transmit controlling and driving signals to the liquid crystal display panel 114. The backlight module 120 is adapted to provide the light into the liquid crystal display panel 114. The backlight module 120 is assembled with the front frame 112 so as to combine the front frame 112, the liquid crystal display panel 114 and the backlight module 120 to the liquid crystal display device 110. Referring to FIG. 11, the backlight module 120 includes a light source unit 124 (e.g. light emitting diode light bar) and a flexible printed circuit (FPC) board 126. One end of the FPC board 126 is mounted to the light source unit 124, the other end of the FPC board 126 is mounted to the connector 130 for electrically connecting the light source unit 124 to the connector 130.

Compared with the conventional connector having no immovable mechanism (i.e. FPC board possibly escapes from the connector) in the prior art, the connector of the present invention has an immovable mechanism between the cover and the base for keeping the immovable condition of the FPC board, and then the light bar can be energized to illumine the liquid crystal panel during assembling and test processes of the liquid crystal panel.

Although the invention has been explained in relation to its preferred embodiment, it is not used to limit the invention. It is to be understood that m any other possible modifications and variations can be made by those skilled in the art without departing from the spirit and scope of the invention as hereinafter claimed.

What is claimed is:

1. A connector for mounting a flexible printed circuit (FPC) board, the FPC board having a positioning portion, the connector comprising:

a base including an opening and a first connecting portion located at two sides of the opening; and a cover pivotally connected to the base, including a second connecting portion;

wherein the base further includes a third connecting portion; and the cover further includes a fourth connecting portion snapped into the third connecting portion, wherein when the cover is turned and then the second connecting portion is engaged with the first connecting portion, there is an accommodating space formed between the cover and the opening of the base for accommodating the FPC board, and the first and second connecting portions are adjacent to the positioning portion of the FPC board, whereby the position portioning of the FPC board cannot escape from the accommodating space.

2. The connector as claimed in claim 1, wherein the first connecting portion comprises a convex portion, and the second connecting portion comprises a concave portion, which is engaged with the convex portion.

3. The connector as claimed in claim 1, wherein the first connecting portion comprises a concave portion, and the second connecting portion comprises a convex portion engaged with the concave portion.

4. The connector as claimed in claim 2, wherein the convex portion is one of a rectangular convex portion, a curved convex portion and a right triangular convex portion.

5. The connector as claimed in claim 2, wherein the concave portion is one of a rectangular concave portion, a curved concave portion and a right triangular concave portion.

6. The connector as claimed in claim 2, wherein the shape of the positioning portion is one of a rectangular indentation, a curved indentation and an obtuse triangular indentation.

7. The connector as claimed in claim 1, wherein the third connecting portion comprises one of a convex portion and a convex inclined surface, the fourth connecting portion comprises one of a concave portion and a concave inclined surface, and the convex portion or the convex inclined surface is snapped into the concave portion or the concave inclined surface respectively.

8. The connector as claimed in claim 1, wherein the third connecting portion comprises one of a concave portion or a concave inclined surface, the fourth connecting portion comprises one of a convex portion and a convex inclined surface, and the one of the convex portion and the convex inclined surface is snapped into the one of the concave portion and the concave inclined surface.

9. The connector as claimed in claim 7, wherein the convex portion is a bar-shaped convex portion.

10. The connector as claimed in claim 4, wherein the concave portion is a bar-shaped concave portion.

11. The connector as claimed in claim 4, wherein the volume of the convex portion is substantially the same as that of the concave portion.

12. The connector as claimed in claim 1, wherein the third connecting portion is located at the two sides of the opening.

13. The connector as claimed in claim 1, wherein the base further comprises two short sides, and the third connecting portion is adjacent to the two short sides.

14. A display device comprising:

a display panel comprising a printed circuit board and a connector disposed on the printed circuit board; and a backlight module comprising a light source unit and a flexible printed circuit (FPC) board, wherein the FPC board includes a positioning portion, one end of the FPC board is mounted to the light source unit, the other end of the FPC board is mounted to the connector for electrically connecting the light source unit to the connector, and the connector comprises:

a base including an opening, a first connecting portion located at two sides of the opening; and a cover pivotally connected to the base, including a second connecting portion;

wherein the base further includes a third connecting portion; and the cover further includes a fourth connecting portion snapped into the third connecting portion, wherein when the cover is turned and then the second connecting portion is engaged with the first connecting portion, there is an accommodating space formed between the cover and the opening of the base for accommodating the FPC board, and the first and second connecting portions are adjacent to the positioning portion of the FPC board, whereby the position portioning of the FPC board cannot escape from the accommodating space.

15. The display device as claimed in claim 14, wherein the first connecting portion comprises a convex portion, and the second connecting portion comprises a concave portion, which is engaged with the convex portion.

16. The display device as claimed in claim 14, wherein the first connecting portion comprises a concave portion, and the second connecting portion comprises a convex portion, which is engaged with the concave portion.

17. The display device as claimed in claim 15, wherein the convex portion is one of a rectangular convex portion, a curved convex portion and a right triangular convex portion, and the concave portion is one of a rectangular concave portion, a curved concave portion and a right triangular concave portion.

18. The display device as claimed in claim 15, wherein the shape of the positioning portion is one of a rectangular shape, a curved shape and an obtuse triangular shape.

* * * * *